US008267817B2

(12) United States Patent
Marshall, Jr.

(10) Patent No.: US 8,267,817 B2
(45) Date of Patent: Sep. 18, 2012

(54) FLETCHING SYSTEM AND METHOD THEREFOR

(76) Inventor: John F. Marshall, Jr., Destin, FL (US)

( * ) Notice: Subject to any disclaimer, the term of this patent is extended or adjusted under 35 U.S.C. 154(b) by 0 days.

(21) Appl. No.: 12/787,041

(22) Filed: May 25, 2010

(65) Prior Publication Data

US 2010/0234150 A1 Sep. 16, 2010

Related U.S. Application Data

(63) Continuation of application No. 11/657,676, filed on Jan. 24, 2007, now Pat. No. 7,758,457.

(51) Int. Cl.
*F42B 6/06* (2006.01)

(52) U.S. Cl. ..... 473/586

(58) Field of Classification Search ..... 473/578, 473/585, 586
See application file for complete search history.

(56) References Cited

U.S. PATENT DOCUMENTS

| | | | | |
|---|---|---|---|---|
| 113,835 | A | | 4/1871 | Barton |
| 119,815 | A | | 10/1871 | Brintzinghoffer |
| 509,364 | A | | 11/1893 | Coffeen |
| 1,130,324 | A | | 3/1915 | Owen |
| 1,789,575 | A | | 1/1931 | Allen |
| 1,842,540 | A | | 1/1932 | Cowdery |
| 2,782,036 | A | | 2/1957 | Folberth |
| 2,906,104 | A | * | 9/1959 | Schaefer et al. ..... 62/264 |
| 2,928,373 | A | * | 3/1960 | Esterow ..... 401/105 |
| 3,071,127 | A | | 1/1963 | Spack |
| 4,114,884 | A | | 9/1978 | Tunnicliffe |
| 4,234,192 | A | | 11/1980 | Salamone |
| 4,534,568 | A | | 8/1985 | Tone |
| 4,886,280 | A | | 12/1989 | Bottelsen |
| 5,154,432 | A | | 10/1992 | Saunders |
| 5,427,385 | A | | 6/1995 | Conrad et al. |
| 5,443,273 | A | | 8/1995 | Lovorn |
| 5,987,724 | A | | 11/1999 | Kleman |
| 6,478,700 | B2 | | 11/2002 | Hartman |
| 6,695,727 | B1 | | 2/2004 | Kuhg |
| 7,074,143 | B2 | | 7/2006 | Czemske et al. |
| 2006/0258491 | A1 | | 11/2006 | Walsh |
| 2007/0173359 | A1 | | 7/2007 | Mowery et al. |
| 2008/0176683 | A1 | | 7/2008 | Marshall |

OTHER PUBLICATIONS

U.S. Appl. No. 12/714,064, filed Feb. 26, 2010, Marshall et al.

* cited by examiner

*Primary Examiner* — John Ricci
(74) *Attorney, Agent, or Firm* — Woodcock Washburn LLP

(57) ABSTRACT

A fletching system and method that allows for quick and easy attachment of a fletching member to an arrow shaft provides a slotted arrow shaft adapted to receive a fletching member projecting therethrough and an internal plug member disposed within a hollow center of the arrow shaft in pressing frictional fit engagement with a flanged base portion of the fletching member wherein the flanged base portion is secured between the plug member and an internal surface of a sidewall of the arrow shaft.

22 Claims, 3 Drawing Sheets

FLETCHING SYSTEM AND METHOD THEREFOR

CROSS-REFERENCE TO RELATED APPLICATION

This application is a continuation of U.S. non-provisional application Ser. No. 11/657,676, filed on Jan. 24, 2007, now U.S. Pat. No. 7,758,457, issued on Jul. 20, 2010, entitled "Fletching System and Method Therefor," which is herein incorporated by reference in its entirety.

TECHNICAL FIELD

The present invention relates generally to archery, and more specifically, to a fletching system and method.

BACKGROUND

Bows and arrows have long been used in many various fields of endeavor, such as combat, hunting, sport, competition, and recreation. In almost all instances, accuracy is critical in achieving a successful shot. Most notably, flight characteristics of the arrow play a large role in determining the accuracy of the shot. In order to adjust the flight characteristics of an arrow, one or more fletching member is typically provided on the shaft of an arrow. The design and attachment of the fletching members affect drag, spin, and trueness of flight, in addition to other flight characteristics.

Typically, fletching members are attached to the outside of an arrow shaft using an adhesive. Correct alignment and positioning of the fletching members during attachment is usually attempted by using a fletching jig that retains the fletching members in the proper position while the adhesive cures. Unfortunately, the process of applying the fletching members using conventional jigs is tedious, difficult, time-consuming, and does not ensure accurate results. For example, one or more fletching members may become misaligned, and/or excess adhesive may flow out from between a fletching member and the arrow shaft, making a mess and potentially interfering with the proper function of the fletching members.

In addition, the jig is an expensive piece of specialized equipment and can only be used to apply fletching members to a single arrow shaft at a time. Since the jig must remain attached to the arrow shaft until the adhesive cures, fletching techniques using a conventional jig are limited in their efficiency. Thus, fletching using a conventional jig typically takes a long time and is done well in advance of the time when the arrow is to be fired. This means that arrows are typically transported with the fletching members attached, whereby the fletching members may be damaged or become detached from the arrow shaft, thereby necessitating time-consuming repair.

Finally, conventional fletching techniques cannot practically be performed in the field in the event that a fletching member is damaged during use or transportation, due to inconvenience of carrying the jig, as well as the long curing time associated with the use of adhesive. Thus, archers typically carry more "spare" arrows than they would need if fletching member repair could practically be performed in the field.

It is desirable, therefore, to provide a fletching system, and a method therefor, that ensures proper alignment of the fletching members, is inexpensive, efficient, and easy, thereby reducing the time and cost needed to apply fletching members to an arrow shaft, and that allows fletching members to be attached to an arrow shaft in the field, such as during a repair, thereby reducing the number of "spare" arrows that an archer needs to purchase, prepare, and carry.

SUMMARY

Briefly described, in a preferred embodiment, the present invention overcomes the above-mentioned disadvantages and meets the recognized need for such a system and method therefor by providing an arrow shaft having at least one slot, a fletching member having a flanged base, and a plug member, where the fletching member may be retained in a position projecting through the slot by insertion of the plug member into a hollow center of the arrow shaft.

According to its major aspects and broadly stated, the present invention in its preferred form is a system comprising an arrow shaft having at least one slot formed through a sidewall thereof, a fletching member having a flanged base, and a plug member.

According to another aspect of the preferred embodiment, the slot is formed generally radially through and axially along the sidewall of a hollow portion of an arrow shaft.

According to another aspect of the preferred embodiment, the slot is formed in a spiral configuration.

According to another aspect of the preferred embodiment, the slot is formed in a helical configuration.

According to another aspect of the preferred embodiment, the slot has at least a portion having a greater width than the rest of the slot for slidably receiving the flanged base therethrough.

According to another aspect of the preferred embodiment, the plug member has a nock formed on an end thereof that projects at least partially from an end of the arrow shaft.

According to another aspect of the preferred embodiment, the plug member is retained in removable, frictional fit with an interior surface of the arrow shaft.

According to another aspect of the preferred embodiment, the plug member has a recess formed thereon associated with the flanged base of a respective fletching member.

According to another aspect of the preferred embodiment, the plug member is rotatable to increase a retaining force retaining the flanged base against the interior surface of the arrow shaft.

According to another aspect of the preferred embodiment, conventional fletching members can be used with the system.

The present invention further overcomes the above-mentioned disadvantages and meets the recognized need by providing a method of attaching a fletching member to an arrow shaft comprising the steps of sliding a flanged base portion of a fletching member into a slot formed in the arrow shaft and inserting a plug member into a hollow portion of the arrow shaft such that the plug member is in frictional fit engagement with the flanged base portion, thereby securely attaching the fletching member to the arrow shaft.

Accordingly, a feature and advantage of the present invention is its ability to quickly, accurately, easily, and removably attach a fletching member to an arrow shaft.

Another feature and advantage of the present invention is its ability to allow for replacement of a damaged fletching member.

Yet another feature and advantage of the present invention is ability to enable an unskilled fletcher to properly attach a fletching member to an arrow shaft.

Another feature and advantage of the present invention is its ability to protect a portion of the fletching member attached to the arrow shaft from damage during use or transportation.

Another feature and advantage of the present invention is its ability to allow for spiral or helical arrangement of a fletching member.

These and other objects, features, and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing preferred embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figures 1, 2:
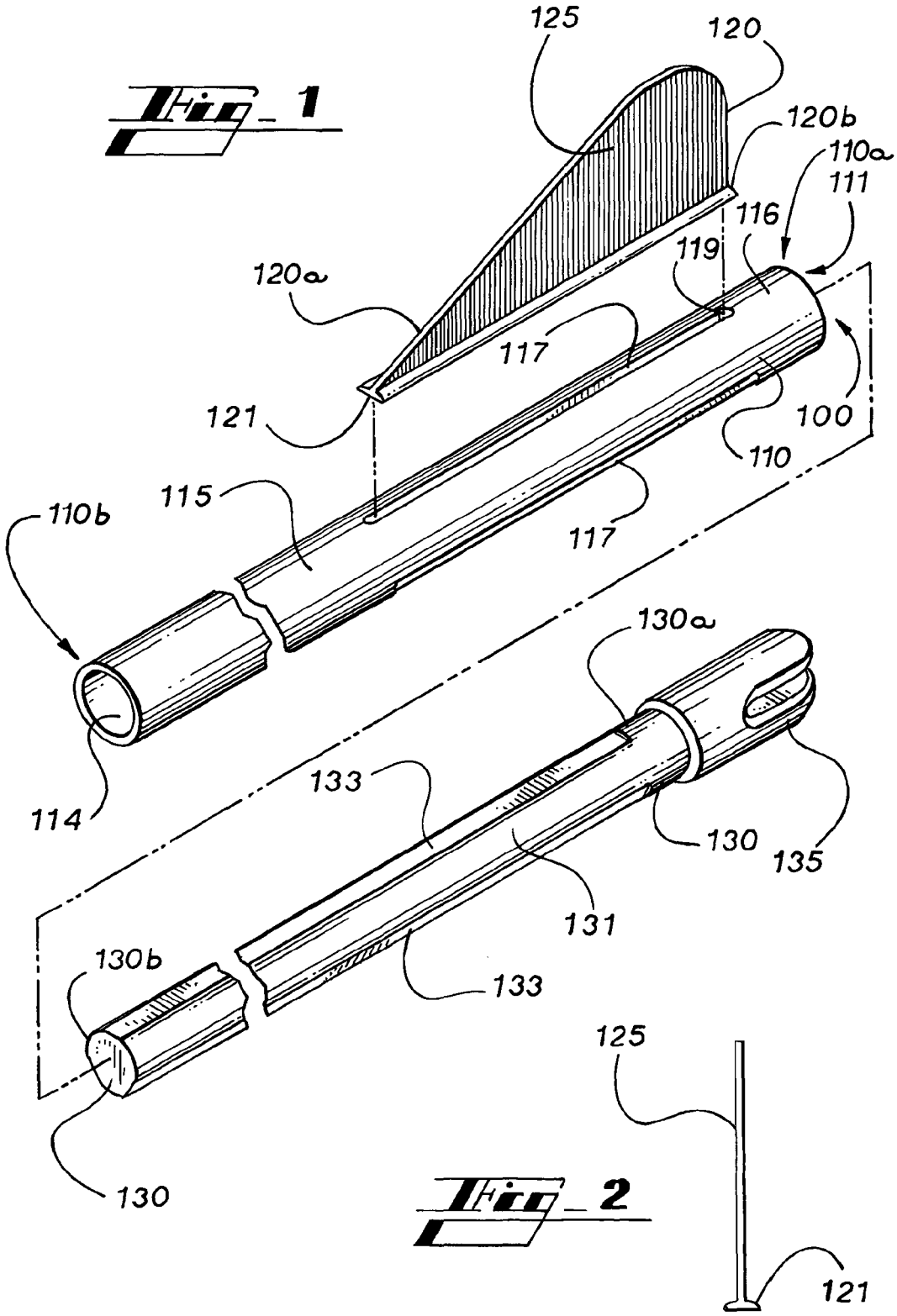
FIG. 1 is an exploded perspective view of the components of the fletching system of the present invention.
FIG. 2 is a cross-sectional view of the fletching member of a preferred embodiment of the present invention.

In that form of the preferred embodiment of the present invention chosen for purposes of illustration, FIG. 1 shows fletching system 100, preferably including arrow shaft 110, at least one fletching member 120, and plug member 130. Arrow shaft 110 preferably comprises an archery arrow shaft generally formed as a hollow circular cylinder. Arrow shaft 110 is preferably formed from aluminum, carbon, or a combination thereof, although arrow shaft 110 may be formed of wood, plastic, graphite, composite, or other suitable material or combinations thereof.

Arrow shaft 110 preferably comprises hollow center 111 disposed along at least a portion of the length of arrow shaft 110 from first end 110*a* to second end 110*b*, preferably proximate first end 110*a* for receiving plug member 130. Hollow center 111 is preferably defined by side wall 115, is preferably open to an outside environment of arrow shaft 110 at first end 110*a*, and preferably extends along the length of arrow shaft 110 toward second end 110*b* at least as far as slot 117. Thus, hollow center 111 preferably allows plug member 130 to be inserted into first end 110*a* and completely underlie slot 117 from within hollow center 111.

Slot 117 is preferably formed radially completely through side wall 115 and preferably extends in a straight line generally axially along the length of arrow shaft 110. Slot 117 may, alternatively, be formed in a curved arrangement, such as spiral or helical. Slot 117 preferably defines a closed periphery, i.e. slot 117 preferably does not extend to either end of arrow shaft 110, thereby allowing fletching member 120 to be completely encircled thereby and retained therein. Slot 117 is preferably formed in arrow shaft 110 by a machining technique, such as CNC routering, but may alternatively be formed by other manufacturing technique, or may be integrally formed with arrow shaft 110 such as during a molding or extrusion process. Slot 117 preferably includes wider portion 119, preferably disposed at an end of slot 117 proximate first end 110*a*, for receiving flanged base 121 of fletching member 120 as described in more detail hereinbelow.

Fletching member 120 preferably comprises a generally T-shape cross section (as best seen in FIG. 2) comprising flanged base 121 and flight control element 125 generally centered thereon and extending generally perpendicular thereto. Alternatively, however, fletching member 120 may comprise other cross-sectional shapes, so long as the base portion has a width preferably greater than a width of flight control element 125, and preferably greater than a width of at least a portion of slot 117. Flanged base 121 preferably provides a means for attaching flight control element 125 to arrow shaft 110 such that flight control element 125 projects generally perpendicular to exterior surface 116 of arrow shaft 110 in order to give arrow shaft 110 beneficial flight characteristics. Preferably, such means for attachment comprises the base portion having a width greater than a width of at least a portion of slot 117, such that once the base portion is disposed within hollow center 111, the base portion may be retained therein by the configuration of slot 117.

Fletching member 120 is preferably formed from plastic such as by a molding or an extrusion process, and flanged base 121 and flight control element 125 are preferably integrally formed. Alternatively, however, fletching member 120 may be formed of any suitable natural or synthetic material which is sufficiently pliable and resilient to allow fletching member 120 to deform upon contact with a foreign object, thereby avoiding or reducing damage thereto, and allowing fletching member 120 to return to its original shape when not in contact with such foreign object. Furthermore, flanged base 121 and flight control element 125 may alternatively be formed of different materials and may be formed separately and joined using an adhesive or other suitable fastener or joining technique. Preferably, flanged base 121 has a width approximately equal to, or slightly less than, the width of wider portion 119, and flight control element 125 preferably has a thickness approximately equal to, or slightly less than, the width of slot 117. Thus, when flanged base 121 is inserted through wider portion 119 and into hollow center 111, preferably starting at first end 120*a* and continuing along the length of fletching member 120 to second end 120*b*, flight control element 125 preferably protrudes through slot 117 and is in friction fit with side wall 115 due to the tight fit of flight control element 125 within slot 117. When inserted through wider portion 119, flanged base 121 preferably remains proximate to or in contact with interior surface 114 of side wall 115.

Plug member 130 is preferably formed as a generally elongated circular cylinder and preferably includes at least one recess 133, such as a flat, formed generally axially along outer surface 131 thereof. Plug member 130 is preferably configured in size and shape such that it fits within hollow center 111 and such that outer surface 131 is in frictional fit engagement with inner surface 114 of side wall 115 when inserted into arrow shaft 110. Furthermore, plug member 130 preferably includes nock 135 disposed on first end 130*a* thereof. Nock 135 is preferably adapted to engage a bow string of an archery bow for use in shooting arrow shaft 110.

Plug member 130 is preferably formed of plastic or other suitable material that is lightweight and sturdy, such as aluminum, carbon, graphite, titanium, magnesium, composite, or other suitable material, and preferably includes nock 135 integrally formed therewith. Nock 135 preferably has a greater diameter than the rest of plug member 130, and more preferably has a diameter approximately equal to arrow shaft 110 such that nock 135 mates flush with first end 110*a* of arrow shaft 110 when plug member 130 is completely inserted in hollow center 111 through first end 110*a*.

Figure 3:
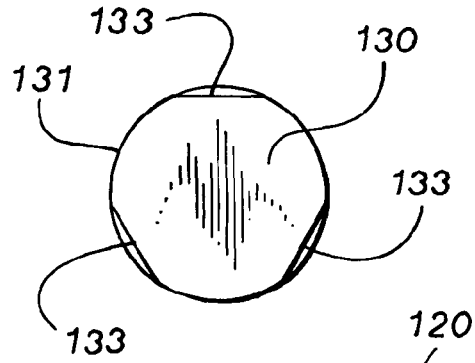
FIG. 3 is a cross-sectional view of the plug member of the preferred embodiment.
Figure 4:
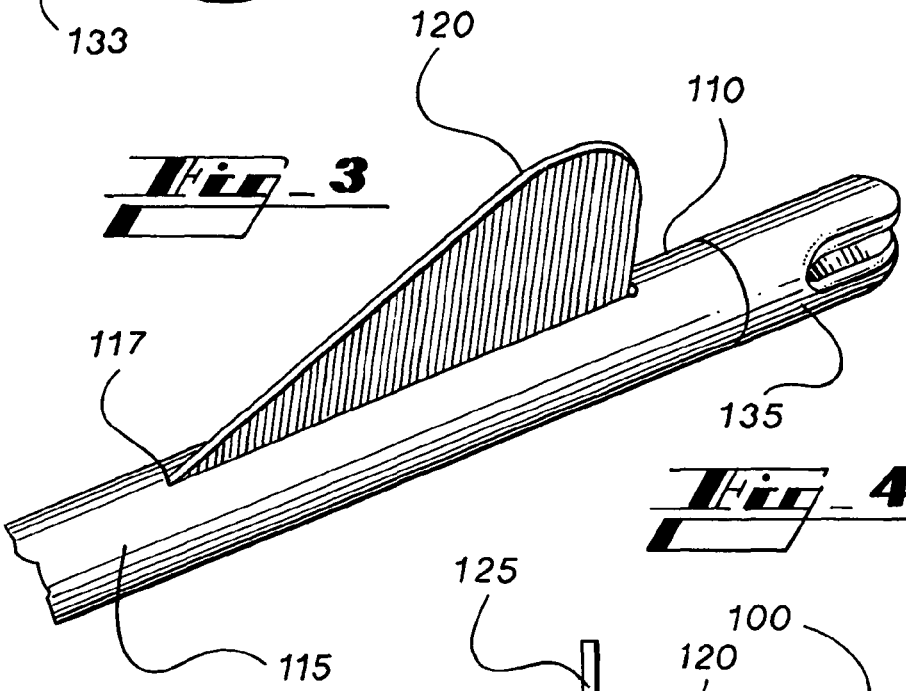
FIG. 4 is a perspective view of the assembled components of the preferred embodiment.
Figure 5:
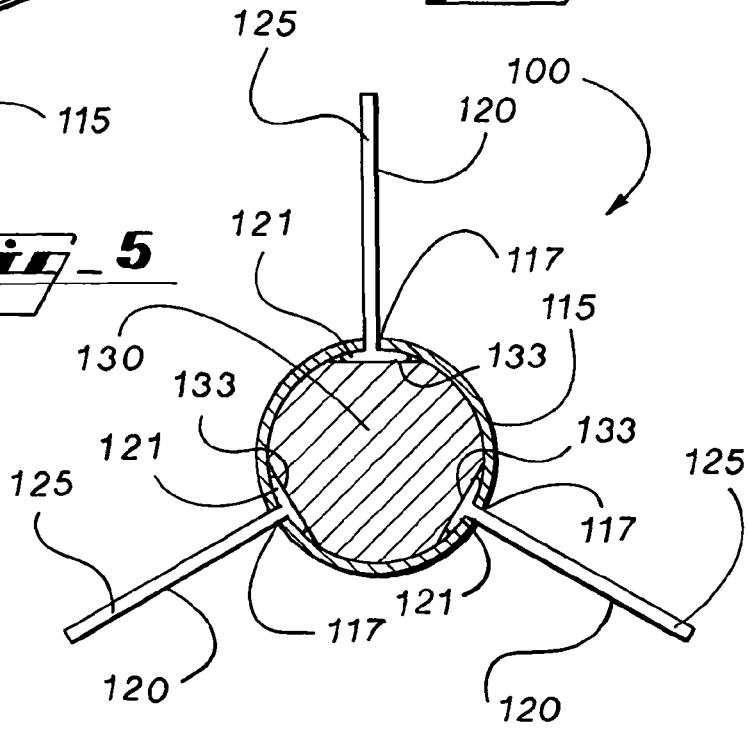
FIG. 5 is a cross-sectional view of the system as shown in FIG. 4.

Preferably, as best shown in FIG. 3, plug member 130 has a number of recesses 130 corresponding to a number of slots 117 formed in arrow shaft 110 and a number of fletching members 120 to be attached to arrow shaft 110. Preferably three fletching members 120 are attached to arrow shaft 110 through three equally-spaced slots 117.

Figure 6A:
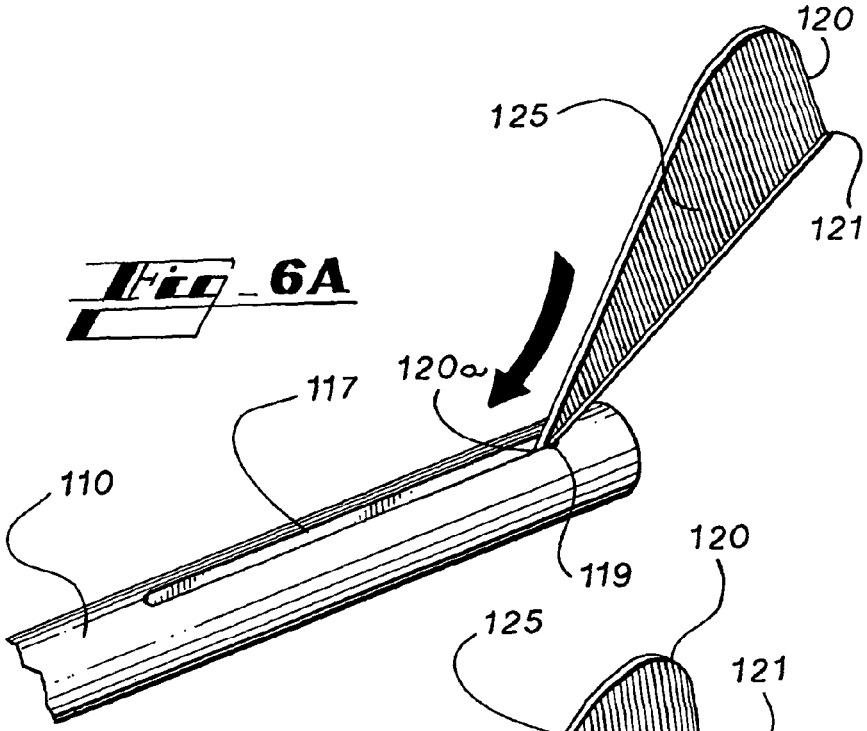
FIGS. 6A-6C are perspective views depicting the insertion of a fletching member into the slot of an arrow shaft according to a preferred embodiment of the present invention.
Figure 6B:
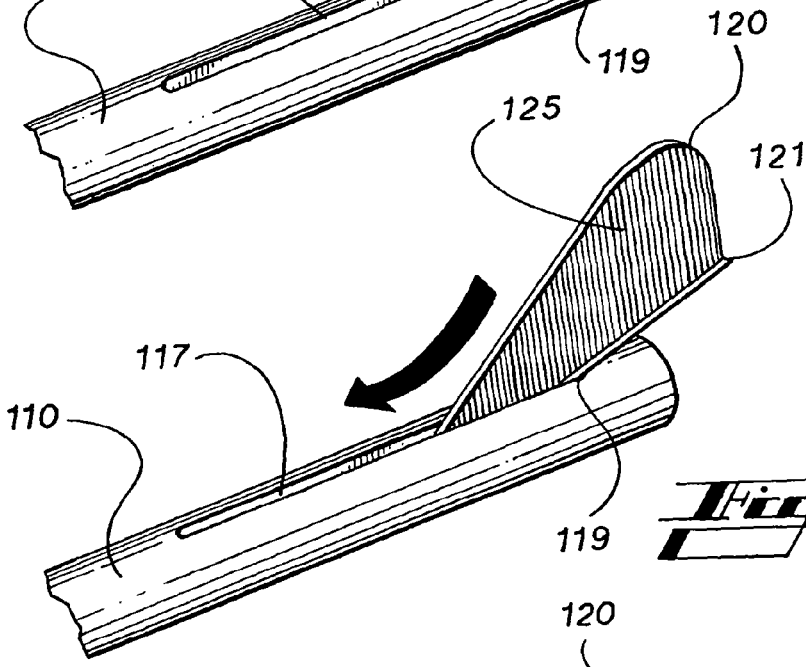
Figure 6C:
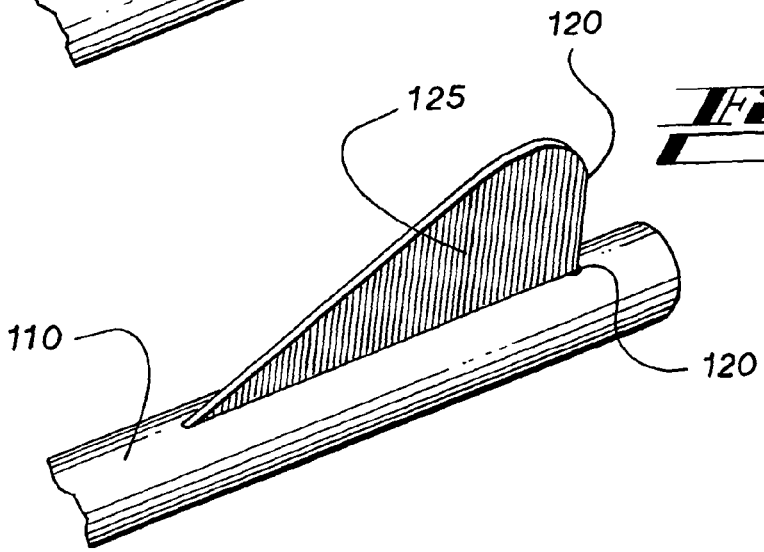

In use, and as illustrated in FIGS. 6A-6C, a portion of flanged base 121 proximate first end 120*a* is preferably inserted through slot 117, preferably at wider portion 119. Fletching member 120 is then preferably slid towards second end 110*b* of arrow shaft 110 such that the rest of flanged base 121 is slid through slot 117, again preferably through wider portion 119. Such sliding insertion of fletching member 120 preferably disposes fletching member 120 projecting through slot 117, with flanged base 121 disposed within hollow center 111. Plug member 130 may then preferably be inserted into hollow center 111 with recess 133 disposed proximate flanged base member 121, thereby allowing for easy insertion of plug member 130. When plug member 130 is fully inserted into hollow center 111, nock 135 preferably abuts first end 110*a*, is flush with exterior surface 116 of sidewall 115, and outer surface 131 of plug member 130 is preferably in frictional fit engagement with interior surface 114 of arrow shaft 110. Preferably, recess 133 of plug member 130 is configured such that flanged base 121 may be retained in pressing fit engagement between recess 133 and internal surface 114 of arrow shaft 110. Optionally, if additional retention force is desired, plug member 130 may be rotated about its central axis within hollow center 111, thereby disposing outer surface 131 in contact with flanged base 121, pinching flanged base 121 between outer surface 131 of plug member 130 and interior surface 114 of arrow shaft 110.

If fletching member 120 becomes damaged or worn, or if a user wishes to remove or replace fletching member 120 for any reason, plug member 130 may preferably be removed from hollow center 111 by pulling it axially out of hollow center 111, preferably by pulling on nock 135. Fletching member 120 may then preferably be removed from slot 117 by sliding flanged base 121 towards first end 110*a*, preferably through wider portion 119, thereby extracting fletching member 120. Alternatively, fletching member 120 may just be pulled radially out of slot 117, whereby flanged base 121 may deform, allowing fletching member 120 to pass through slot 117. Preferably, a new fletching member 120 may then be inserted in slot 117, and retained therein using plug member 130, as described above.

Having, thus, described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed:

1. A fletching system comprising:

a cylindrical arrow shaft having at least one slot formed radially through a sidewall thereof, the slot comprising at least a portion having a greater width than the rest of the slot for slidably receiving a flanged base of a fletching member therethrough, said slot comprising a closed periphery; and a fletching member.

2. The fletching system of claim 1, wherein said slot is formed generally axially in said arrow shaft.

3. The fletching system of claim 1, wherein said slot comprises a first portion having a first width and a second portion having a second width.

4. The fletching system of claim 3, wherein said second portion is disposed adjacent said first portion and proximate an end of said slot.

5. The fletching system of claim 1, wherein said fletching member comprises a generally planar body and a base portion.

6. The fletching system of claim 5, wherein said base portion has a width that is greater than a width of at least a portion of said slot.

7. The fletching system of claim 1, wherein said fletching member is disposed at least partially within said slot and extends therethrough.

8. The fletching system of claim 7, wherein said fletching member is removably retained within said slot by said base portion.

9. The fletching system of claim 1, further comprising a plug adapted for removable insertion into a hollow portion of said arrow shaft through an end thereof.

10. The fletching system of claim 9, wherein said plug comprises a nock portion adapted to engage a bowstring.

11. The fletching system of claim 10, wherein said hollow portion is in fluid communication with said slot and wherein said hollow portion is in fluid communication with an end of said arrow shaft such that said plug may be inserted through said end of said arrow shaft and extend to at least a portion of said slot.

12. The fletching system of claim 9, wherein said hollow portion is disposed proximate said slot.

13. The fletching system of claim 9, wherein said plug is removably retained within a hollow end of said arrow shaft.

14. A fletching system comprising:

a fletching member comprising a flanged base;

a cylindrical arrow shaft having at least one slot formed through a sidewall thereof, said slot comprising at least a portion having a greater width than the rest of the slot for slidably receiving said flanged base of said fletching member therethrough;

said flanged base receivable through said wider portion of said slot and into a hollow center of said arrow shaft, said fletching member for protruding through said slot and being captured in a frictional fit with said side wall.

15. The fletching system of claim 14 wherein said fletching member is held within said slot by a compression force.

16. The fletching system of claim 15 wherein said compression force is provided by a nock.

17. The fletching system of claim 15 wherein said compression force is provided by the configuration of said slot.

18. A fletching system comprising:

a cylindrical arrow shaft having at least one slot formed radially through a sidewall thereof, the slot comprising at least a portion having a greater width than the rest of the slot for slidably receiving a flanged base of a fletching member therethrough, and a plug adapted for removable insertion into a hollow portion of said arrow shaft through an end thereof.

19. The fletching system of claim 18, wherein said plug comprises a nock portion adapted to engage a bowstring.

20. The fletching system of claim 18, wherein said hollow portion is disposed proximate said slot.

21. The fletching system of claim 18, wherein said hollow portion is in fluid communication with said slot and wherein said hollow portion is in fluid communication with an end of said arrow shaft such that said plug may be inserted through said end of said arrow shaft and extend to at least a portion of said slot.

22. The fletching system of claim 18, wherein said plug is removably retained within a hollow end of said arrow shaft.

* * * * *